US010759186B2

(12) United States Patent
Kubota

(10) Patent No.: US 10,759,186 B2
(45) Date of Patent: Sep. 1, 2020

(54) TAPE PRINTER

(71) Applicant: SEIKO EPSON CORPORATION, Tokyo (JP)

(72) Inventor: Tomoyuki Kubota, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 145 days.

(21) Appl. No.: 15/911,984

(22) Filed: Mar. 5, 2018

(65) Prior Publication Data

US 2018/0257397 A1 Sep. 13, 2018

(30) Foreign Application Priority Data

Mar. 10, 2017 (JP) ..... 2017-045921

(51) Int. Cl.

| | |
|---|---|
| ***B41J 32/00*** | (2006.01) |
| ***B41J 15/04*** | (2006.01) |
| ***B41J 3/407*** | (2006.01) |
| ***B65H 16/02*** | (2006.01) |
| ***B41J 15/02*** | (2006.01) |

(52) U.S. Cl.

CPC ..... *B41J 3/407* (2013.01); *B41J 3/4075* (2013.01); *B41J 15/02* (2013.01); *B41J 15/044* (2013.01); *B65H 16/02* (2013.01)

(58) Field of Classification Search

CPC ..... B41J 3/4075; B41J 15/044; B41J 32/00

USPC ..... 400/613

See application file for complete search history.

(56) References Cited

U.S. PATENT DOCUMENTS

| | | | |
|---|---|---|---|
| 2010/0166475 | A1 | 7/2010 | Yamaguchi et al. |
| 2010/0166477 | A1 | 7/2010 | Yamaguchi et al. |
| 2010/0166478 | A1 | 7/2010 | Yamaguchi et al. |
| 2010/0166479 | A1 | 7/2010 | Yamaguchi et al. |
| 2010/0166480 | A1 | 7/2010 | Yamaguchi et al. |
| 2010/0247205 | A1 | 9/2010 | Yamaguchi et al. |
| 2010/0247206 | A1 | 9/2010 | Yamaguchi et al. |
| 2010/0247207 | A1 | 9/2010 | Sago et al. |
| 2010/0247208 | A1 | 9/2010 | Yamaguchi et al. |
| 2010/0247209 | A1 | 9/2010 | Yamaguchi et al. |
| 2010/0247210 | A1 | 9/2010 | Yamaguchi et al. |
| 2010/0247212 | A1 | 9/2010 | Yamaguchi et al. |
| 2010/0254742 | A1 | 10/2010 | Yamaguchi et al. |

(Continued)

FOREIGN PATENT DOCUMENTS

| | | | |
|---|---|---|---|
| CN | 106132719 | A | 11/2016 |
| JP | 07-025122 | A | 1/1995 |

(Continued)

*Primary Examiner* — Leslie J Evanisko

(74) *Attorney, Agent, or Firm* — Foley & Lardner LLP

(57) ABSTRACT

A tape printer that includes: a cartridge loading portion to which a tape cartridge is loaded, the tape cartridge including a cartridge case and a platen roller accommodated in the cartridge case, the cartridge case having a positioning recess and a first detection target portion of which shape is varied depending on various types of tape cartridge; a platen shaft provided in the cartridge loading portion and inserted into the platen roller; a first detection unit provided in the cartridge loading portion, of which output changes depending on the shape of the first detection target portion; and a positioning projection provided at a position farther than the first detection unit with respect to the platen shaft in the cartridge loading portion when seen from a near side in a loading direction of the tape cartridge, and engaging with the positioning recess.

4 Claims, 11 Drawing Sheets

(56) References Cited

U.S. PATENT DOCUMENTS

| | | | |
|---|---|---|---|
| 2012/0008999 | A1 | 1/2012 | Yamaguchi et al. |
| 2012/0080550 | A1 | 4/2012 | Yamaguchi et al. |
| 2012/0188325 | A1 | 7/2012 | Yamaguchi et al. |
| 2012/0189366 | A1 | 7/2012 | Yamaguchi et al. |
| 2012/0201588 | A1 | 8/2012 | Yamaguchi et al. |
| 2013/0142560 | A1 | 6/2013 | Yamaguchi et al. |
| 2013/0315644 | A1 | 11/2013 | Yamaguchi et al. |
| 2014/0112694 | A1 | 4/2014 | Yamaguchi et al. |
| 2014/0175204 | A1 | 6/2014 | Yamaguchi et al. |
| 2014/0199108 | A1 | 7/2014 | Yamaguchi et al. |
| 2014/0204170 | A1 | 7/2014 | Yamaguchi et al. |
| 2014/0205341 | A1 | 7/2014 | Yamaguchi et al. |
| 2014/0205342 | A1 | 7/2014 | Yamaguchi et al. |
| 2014/0205343 | A1 | 7/2014 | Yamaguchi et al. |
| 2014/0205344 | A1 | 7/2014 | Yamaguchi et al. |
| 2014/0205345 | A1 | 7/2014 | Yamaguchi et al. |
| 2014/0205346 | A1 | 7/2014 | Yamaguchi et al. |
| 2014/0205347 | A1 | 7/2014 | Yamaguchi |
| 2014/0205348 | A1 | 7/2014 | Yamaguchi et al. |
| 2014/0205349 | A1 | 7/2014 | Yamaguchi et al. |
| 2014/0205350 | A1 | 7/2014 | Yamaguchi et al. |
| 2014/0205352 | A1 | 7/2014 | Yamaguchi et al. |
| 2014/0205353 | A1 | 7/2014 | Yamaguchi et al. |
| 2014/0320581 | A1 | 10/2014 | Yamaguchi et al. |
| 2015/0174932 | A1 | 6/2015 | Yamaguchi et al. |
| 2015/0183246 | A1 | 7/2015 | Yamaguchi et al. |
| 2015/0283836 | A1 | 10/2015 | Sakano et al. |
| 2015/0298476 | A1 | 10/2015 | Yamaguchi et al. |
| 2016/0039230 | A1 | 2/2016 | Yamaguchi et al. |
| 2016/0229210 | A1 | 8/2016 | Yamaguchi et al. |
| 2016/0236495 | A1 | 8/2016 | Sakano et al. |
| 2016/0271983 | A1 | 9/2016 | Sakano |
| 2016/0361918 | A1 | 12/2016 | Yamaguchi et al. |
| 2016/0368275 | A1 | 12/2016 | Sakano et al. |
| 2016/0368284 | A1 | 12/2016 | Yamaguchi et al. |
| 2017/0008318 | A1 | 1/2017 | Yamaguchi et al. |
| 2017/0087901 | A1 | 3/2017 | Sakano |
| 2017/0100948 | A1 | 4/2017 | Yamaguchi et al. |
| 2018/0037043 | A1 | 2/2018 | Sakano et al. |
| 2019/0030935 | A1 | 1/2019 | Sakano et al. |

FOREIGN PATENT DOCUMENTS

| | | | |
|---|---|---|---|
| JP | 2009-132064 | A | 6/2009 |
| JP | 2012-126141 | A | 7/2012 |
| JP | 2012-158175 | A | 8/2012 |
| JP | 2016-068468 | A | 5/2016 |

TAPE PRINTER

BACKGROUND

1. Technical Field

The invention relates to a tape printer to which a tape cartridge is loaded.

2. Related Art

JP-A-2012-158175 is an example of related art of a tape printer in which a positioning projection (a positioning pin) to engage with a positioning recess (a pin hole) is provided in a cartridge loading portion (a cassette loading portion) to which a tape cartridge (a tape cassette) having the positioning recess is to be loaded. In this related art tape printer, the positioning projections are located closer than a detection unit (a switch unit) to a platen shaft (a tape driving shaft). The positioning projection is located away from a print head (a thermal head). In this paragraph, the terms in the parentheses are those used in JP-A-2012-158175.

In this kind of related art tape printers, when a platen shaft is inserted into a platen roller of a tape cartridge loaded in a cartridge loading portion and the platen roller is rotated, rotational force about the platen shaft will act on the tape cartridge. If the positioning projection is located closer to the platen shaft than the detection unit is as in the related art tape printers, when the tape cartridge is rotated about the platen shaft, a detection target is shifted with respect to the detection unit and the shift amount will become greater than a backlash between the positioning projection and a positioning recess. As in the related art tape printers, if the positioning projection is located away from the print head, a dimension error between the positioning projection and the print head increases as compared with a case in which the positioning projection is located close to the print head. Therefore, it is possible that the platen roller cannot be correctly positioned with respect to the print head even in a state in which the positioning projection engages with the positioning recess.

SUMMARY

An advantage of some aspects of the invention is to provide a tape printer capable of correctly positioning a tape cartridge in a cartridge loading portion.

According to an aspect of the invention, a tape printer includes: a cartridge loading portion to which a tape cartridge is loaded, the tape cartridge including a cartridge case and a platen roller accommodated in the cartridge case, the cartridge case having a positioning recess and a first detection target portion of which shape is varied depending on various types of tape cartridge; a platen shaft provided in the cartridge loading portion and inserted into the platen roller; a first detection unit provided in the cartridge loading portion, of which output changes depending on the shape of the first detection target portion; and a positioning projection provided at a position farther than the first detection unit with respect to the platen shaft in the cartridge loading portion when seen from a near side in a loading direction of the tape cartridge, and engaging with the positioning recess.

According to this configuration, the positioning projection is located farther than the first detection unit with respect to the platen shaft. Therefore, also when the platen roller is rotated in a state in which the tape cartridge is loaded in the cartridge loading portion and the tape cartridge is rotated about the platen shaft, a shift amount of the first detection target portion with respect to the first detection unit becomes smaller than an amount of a backlash between the positioning projection and the fitting hole. Therefore, the first detection target portion can be correctly positioned with respect to the first detection unit. With this configuration, the tape cartridge can be correctly positioned in the cartridge loading portion.

In this case, it is desirable that the cartridge case includes a first case that includes a fitting pin, and a second case that has a fitting hole into which the fitting pin is to be inserted and that is assembled separably from the first case and the positioning projection engages with the fitting hole which functions as a positioning recess.

According to this configuration, fitting hole can be used as positioning recess. That is, it can have function as location where fitting pins are inserted in fitting hole, and function as location which positioning projection engages.

In this case, it is desirable that the first detection unit is provided at one of a plurality of corners of the cartridge loading portion when seen from a near side in the loading direction of the tape cartridge, and the positioning projection is provided in the cartridge loading portion at a corner at which the first detection unit is provided.

According to this configuration, positioning projection is provided in corner in which first detection unit was provided. That is, the positioning projection is provided close to the first detection unit. Therefore, things can do small dimension error between positioning projection and first detection unit. Therefore, in a state in which the positioning projection engages with the positioning recess, the first detection target portion can be correctly positioned with respect to the first detection unit.

According to another aspect of the invention, a tape printer includes: a cartridge loading portion to which a tape cartridge is loaded, the tape cartridge including a cartridge case and a platen roller accommodated in the cartridge case, the cartridge case having a positioning recess and a head inserting portion; a print head provided in the cartridge loading portion and prints on a tape pinched between the print head and the platen roller; a substantially rectangular head cover provided in the cartridge loading portion so as to cover the print head and is inserted into the head inserting portion; and a positioning projection provided in a peripheral portion of the head cover in the cartridge loading portion when seen from a near side in a loading direction of the tape cartridge, and engaging with the positioning recess.

According to this configuration, positioning projection is provided with print head in peripheral portion of coat head cover. That is, the positioning projection is provided close to the print head. Therefore, a dimension error between the positioning projection and the print head can be reduced. Therefore, in a state in which the positioning projection engages with the positioning recess, the platen roller can be correctly positioned with respect to the print head. Thus, in cartridge loading portion, tape cartridge can be positioned properly.

In this case, it is desirable that the cartridge case includes a first case that includes a fitting pin, and a second case that has a fitting hole into which the fitting pin is to be inserted, and that is assembled separably from the first case, and the positioning projection engages with a fitting hole which functions as a positioning recess.

According to this configuration, the fitting hole can be used as the positioning recess. That is, the fitting hole can have both the function of the position into which the fitting pin is to be inserted and the function as the position with which the positioning projection engages.

In this case, it is desirable that the positioning projection is provided at mutually diagonal positions of the head cover when seen from the near side in the loading direction of the tape cartridge.

With this configuration, since the positioning projection engages with the positioning recess at the mutually diagonal positions of the head cover, a platen roller can be correctly positioned with respect to a print head.

In this case, it is desirable that the cartridge case includes a second detection target portion of which shape is varied depending on various types of the tape cartridge, the tape printer further includes a second detection unit provided at one of a plurality of corners of the cartridge loading portion when seen from the near side in the loading direction of the tape cartridge and of which output changes depending on the shape of the second detection target portion, and the positioning projection is provided in the cartridge loading portion at a corner at which the second detection unit is provided.

According to this configuration, the positioning projection is provided at the corner at which the second detection unit is provided. That is, the positioning projection is provided close to the second detection unit. Therefore, a dimension error between the positioning projection and the second detection unit can be reduced. Therefore, in a state in which the positioning projection engages with the positioning recess, the second detection target portion can be correctly positioned with respect to the second detection unit.

In this case, it is desirable that a winding support portion that rotatably supports a ribbon winding core is provided in the cartridge case, the tape printer further includes a winding shaft provided in the cartridge loading portion and is inserted into the ribbon winding core, and the positioning projection is provided in a peripheral portion of a side closest to the winding shaft when seen from the near side in the loading direction of the tape cartridge among a plurality of sides which constitute a contour of the head cover.

According to this configuration, the positioning projection is provided in the peripheral portion of a side closest to the winding shaft. That is, the positioning projection is provided close to the winding shaft. Therefore, a dimension error between the positioning projection and the winding shaft can be reduced. Therefore, in a state in which the positioning projection engages with the positioning recess, the winding support portion can be correctly positioned with respect to the winding shaft.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a first embodiment of a tape printer of the invention will be described. An XYZ orthogonal coordinate system is illustrated as necessary in the diagrams referred to below to clarify positional relationships of the members. However, the coordinates system does not limit the invention.

Figure 1:
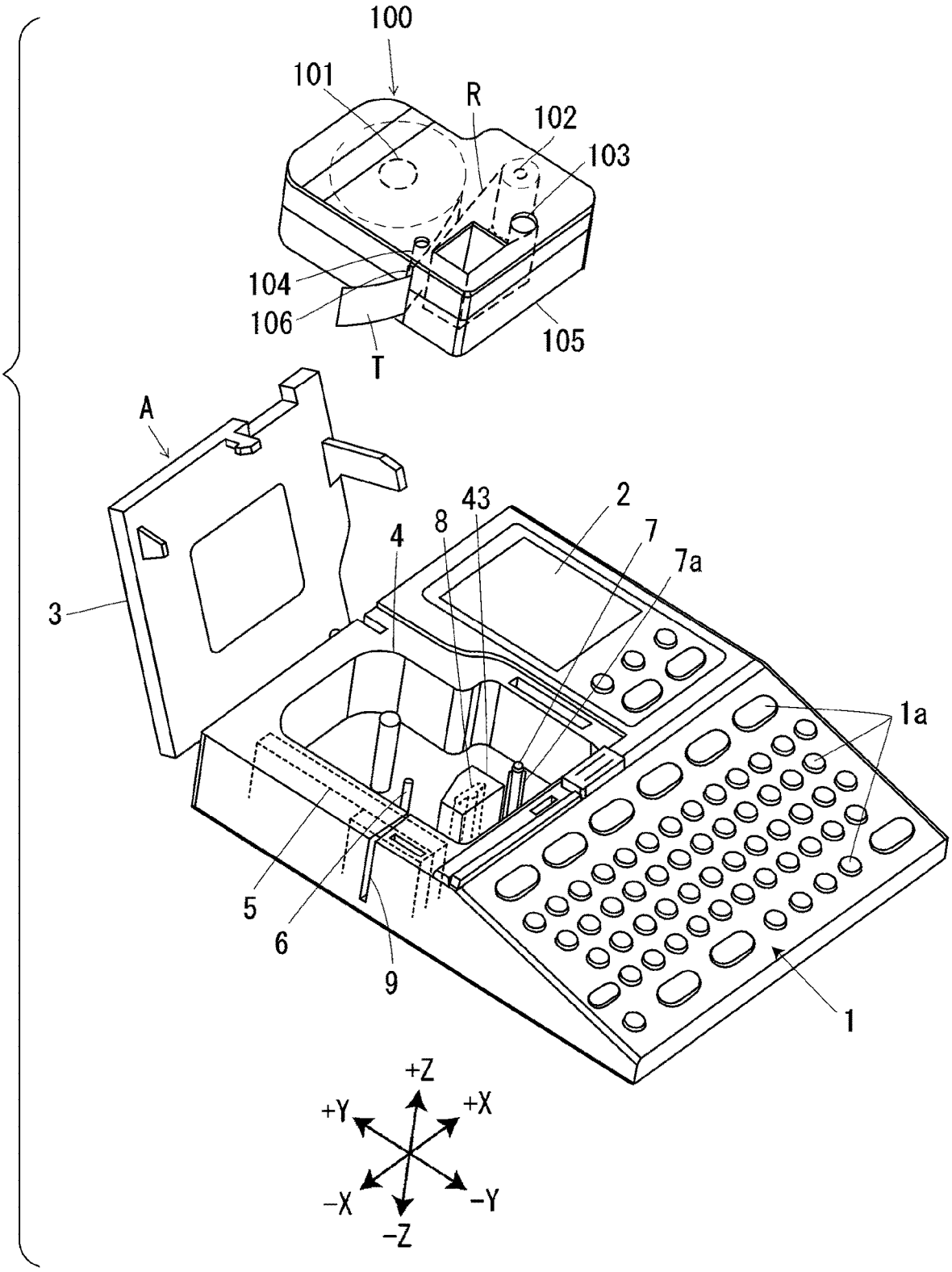
FIG. 1 is a schematic diagram illustrating a configuration of a tape printer and a tape cartridge to be loaded in the tape printer according to a first embodiment of the invention.

A schematic configuration of a tape printer A and a tape cartridge 100 which is to be loaded to the tape printer A will be described with reference to FIG. 1.

The tape printer A includes an operation panel 1, a display 2, a tape cartridge cover 3, a cartridge loading portion 4, and a cutter 5. The cartridge loading portion 4 includes a platen shaft 6, a winding shaft 7, and a thermal head 8. Though not illustrated in FIG. 1, the tape printer A further includes a controller 13 (see FIG. 2) and other components.

Buttons 1*a*, including text buttons, selection buttons, and a print button, are provided on the operation panel 1. The operation panel 1 detects operations by a user with respect to the buttons 1*a*.

The display 2 displays, for example, input character strings based on a detection result of an operation with respect to the buttons 1*a*. The display 2 performs various types of display based on detection results of sensors provided in the components of the tape printer A.

The tape cartridge cover 3 is attached to rotate about an end portion thereof, and opens and closes the cartridge loading portion 4. The tape cartridge cover 3 is opened and closed when, for example, the user removes and replaces the tape cartridge 100 with respect to the cartridge loading portion 4.

The tape cartridge 100 is replaceably loaded in the cartridge loading portion 4. The tape cartridge 100 includes a tape core 101, a ribbon sending core 102, a ribbon winding core 103, a platen roller 104, and a cartridge case 105 accommodating these members. A tape T is wound round the tape core 101 in a roll form. The tape T unwound from the tape core 101 is sent out of the cartridge case 105 through a tape sending-out port 106 provided in the cartridge case 105. An ink ribbon R is wound round the ribbon sending core 102 in a roll form. The ink ribbon R unwound from the ribbon sending core 102 is wound round the ribbon winding core 103. A plurality of types of the tape cartridges 100 is prepared for different characteristics, such as a tape width (a dimension of the tape T in the width direction), a color of the tape T, and a color of the ink ribbon R.

A base end of the platen shaft 6 is fixed to a metal frame (not illustrated) provided on the far side in the loading direction (−Z side) of the tape cartridge 100 with respect to the cartridge loading portion 4, and the platen shaft 6 projects on the near side in the loading direction of the tape cartridge 100 (+Z side) (hereinafter, the loading direction of the tape cartridge 100 will be simply referred to as a "loading direction"). A platen rotor (not illustrated) is rotatably provided in the platen shaft 6. When the tape cartridge 100 is loaded in the cartridge loading portion 4, the platen shaft 6 is inserted into the platen roller 104 and the platen rotor engages with the platen roller 104. When the platen rotor rotates in this state, the platen roller 104 is rotated, and the tape T and the ink ribbon R pinched between the platen roller 104 and the thermal head 8 are transported. When the platen roller 104 is rotated, rotational force about the platen shaft 6 will act on the tape cartridge 100. Therefore, the tape cartridge 100 may be rotated inside the cartridge loading portion 4 by the amount of a backlash between the cartridge loading portion 4 and the tape cartridge 100 (in particular, a backlash between a later-described positioning projection 49 (see FIG. 6) and a fitting hole 129 (see FIG. 4)).

A base end of the winding shaft 7 is fixed to a frame provided on the far side in the loading direction (−Z side) with respect to the cartridge loading portion 4 and projects on the near side in the loading direction (+Z side) as in the platen shaft 6. A winding rotor 7*a* is rotatably provided in the winding shaft 7. When the tape cartridge 100 is loaded in the cartridge loading portion 4, the winding shaft 7 engages with the ribbon winding core 103. When the winding rotor 7*a* rotates in this state, the ribbon winding core 103 is rotated and the ink ribbon R unwound from the ribbon sending core 102 is wound round the ribbon winding core 103.

The thermal head 8 generates heat based on a detection result of the operations with respect to the buttons 1*a* when the tape T and the ink ribbon R pinched between the thermal head 8 and the platen roller 104 are transported. Therefore, ink of the ink ribbon R is transferred to the tape T and the input character strings are printed on the tape T. A printed portion of the tape T is discharged from a tape discharge port 9. The thermal head 8 is covered with a later-described head cover 43.

A cutter 5 is provided between the cartridge loading portion 4 and the tape discharge port 9. The cutter 5 cuts, in the width direction of the tape T, the tape T unwound from the tape cartridge 100 loaded in the cartridge loading portion 4. Therefore, the printed portion of the tape T is separated from the tape T. The separated printed portion of the tape T can be stuck to a desirable position by the user as a label.

Figure 2:
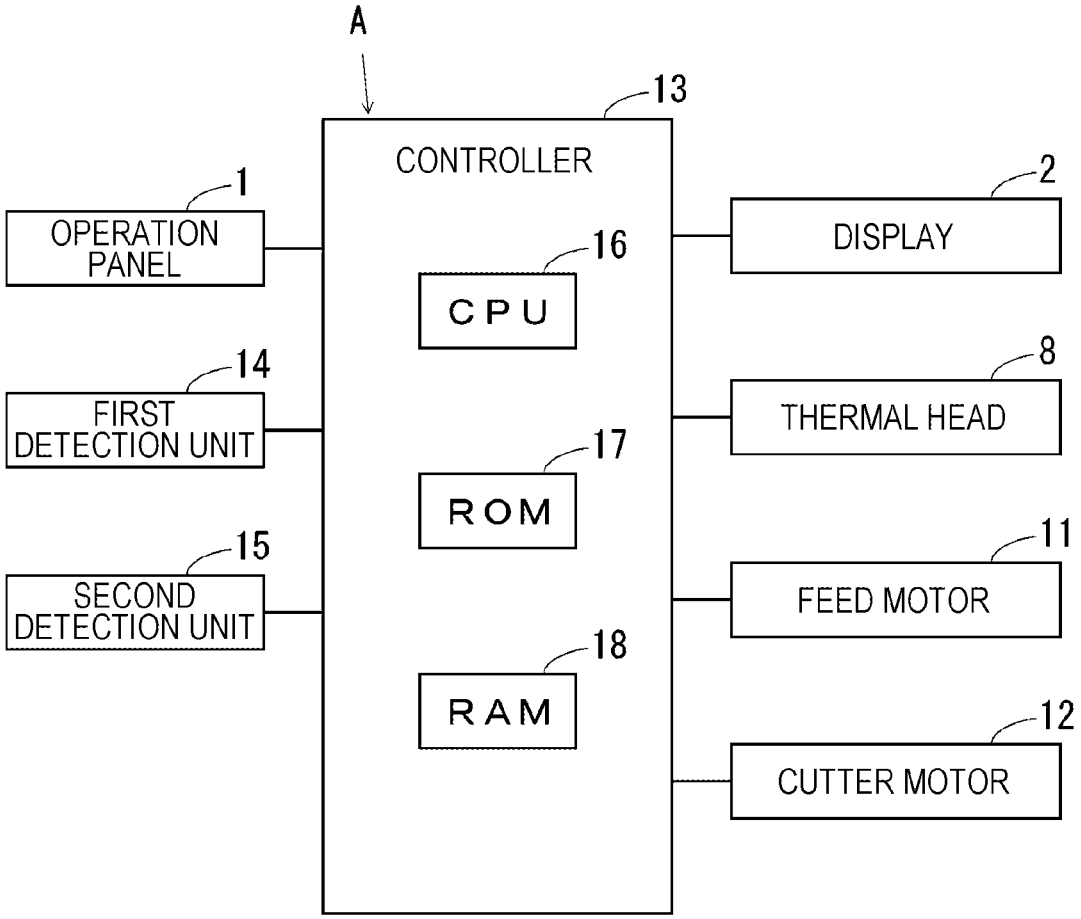
FIG. 2 is a block diagram illustrating a control configuration of the tape printer.

A control configuration of the tape printer A will be described with reference to FIG. 2. In addition to the operation panel 1, the display 2, and the thermal head 8, the tape printer A includes a feed motor 11, a cutter motor 12, a first detection unit 14, a second detection unit 15, and the controller 13.

The feed motor 11 is a driving source which rotates the platen rotor and the winding rotor 7*a*. The cutter motor 12 is a driving source which causes the cutter 5 to perform a cutting operation. The feed motor 11 and the cutter motor 12 may be a single motor having functions of these motors.

The controller 13 includes a central processing unit (CPU) 16, read only memory (ROM) 17, and random access memory (RAM) 18. The CPU 16 executes a program stored in the ROM 17 using the RAM 18. The controller 13 outputs control signals to a driver circuit (not illustrated) which drives the display 2, the thermal head 8, the feed motor 11, and the cutter motor 12. Outputs from the operation panel 1, the first detection unit 14, and the second detection unit 15 are input into the controller 13. The first detection unit 14 and the second detection unit 15 will be described later.

Figure 3:
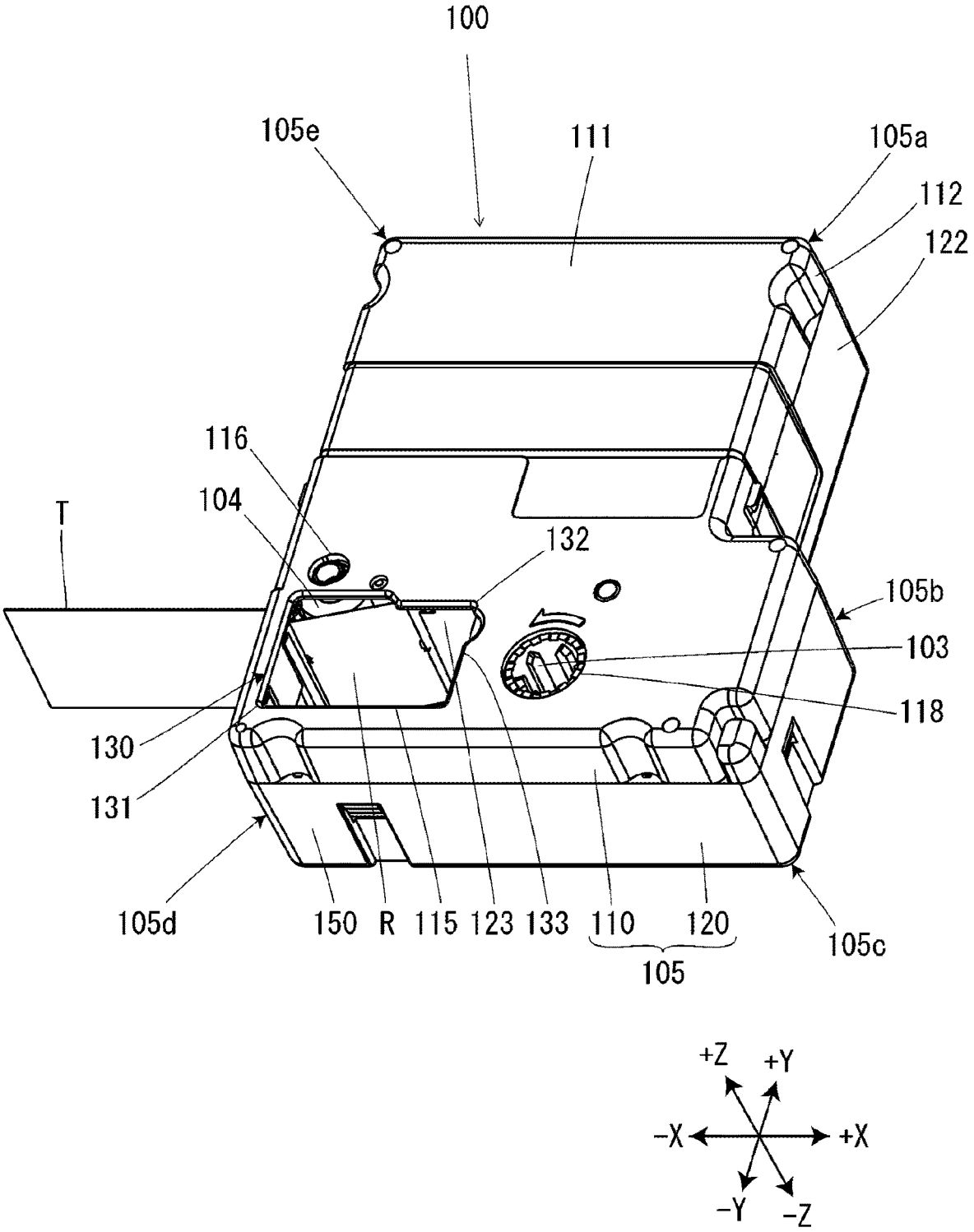
FIG. 3 is a perspective view of the tape cartridge.

The tape cartridge 100 will be described with reference to FIGS. 3 and 4. As described above, the tape cartridge 100 includes the tape core 101 (not illustrated in FIGS. 3 and 4), the ribbon sending core 102 (not illustrated in FIG. 3), the ribbon winding core 103, the platen roller 104, and the cartridge case 105.

The cartridge case 105 is formed in a substantially reversed "L" shape (see FIG. 4) when seen from the far side in the loading direction (−Z side) with five corners. Among the five corners of the cartridge case 105, a corner on a +X side and a +Y side is defined as a first case corner 105*a*, a corner on the +X side and a −Y side is defined as a third case corner 105*c*, a corner on a −X side and the −Y side is defined as a fourth case corner 105*d*, a corner on the −X side and the +Y side is defined as a fifth case corner 105*e*, and a corner between the first case corner 105*a* and the third case corner 105*c* is defined as a second case corner 105*b*.

A head inserting portion 130 is provided at the fourth case corner 105*d* of the cartridge case 105. When the tape cartridge 100 is loaded in the cartridge loading portion 4, the head cover 43 is inserted into the head inserting portion 130 from the far side in the loading direction (−Z side). The head inserting portion 130 is formed as a through hole penetrating the cartridge case 105 in the loading direction (the Z side). The head inserting portion 130 may be formed in a bag shape with a bottom on the near side in the loading direction (+Z side) as long as there is no influence on the head cover 43 (that is, the head inserting portion 130 is not in contact with the head cover 43).

The head inserting portion 130 is substantially rectangular when seen from the far side in the loading direction (−Z side). Here, when seen from the far side in the loading direction, among the four corners of the head inserting portion 130, a corner in the fourth case corner 105*d* is defined as a first insertion corner 131, and a corner diagonal to the first insertion corner 131 is defined as a second insertion corner 132. Among the four sides which constitute a contour of the head inserting portion 130, a side closest to the ribbon winding core 103 when seen from the far side in the loading direction is defined as a winding core side insertion side 133.

The cartridge case 105 includes a first case 110 and a second case 120. When the tape cartridge 100 is loaded in the cartridge loading portion 4, the first case 110 is located on the near side in the loading direction (+Z side) and the second case 120 is located on the far side in the loading direction (−Z side). The first case 110 and the second case 120 are assembled separably from each other. The first case 110 and the second case 120 are made of resin and are formed by injection molding. However, the materials and the manufacturing process of the first case 110 and the second case 120 are not limited to those described above.

The first case 110 includes a first base portion 111 and a first peripheral wall portion 112.

A first insertion opening 115, a first platen support opening 116, and a first winding support opening 118 are provided in the first base portion 111. The first insertion opening 115 is an end portion in the head inserting portion 130 located on the near side in the loading direction (+Z side). An end portion of the platen roller 104 on the near side in the loading direction engages with the first platen support opening 116. An end portion of the ribbon winding core 103 on the near side in the loading direction engages with the first winding support opening 118. Though not unillustrated, a boss-shaped first sending support portion is provided on an inner surface of the first base portion 111. An end portion of the ribbon sending core 102 on the near side in the loading direction engages with the first sending support portion.

The first peripheral wall portion 112 projects on the far side in the loading direction (−Z side) from a peripheral portion of the first base portion 111.

Figure 4:
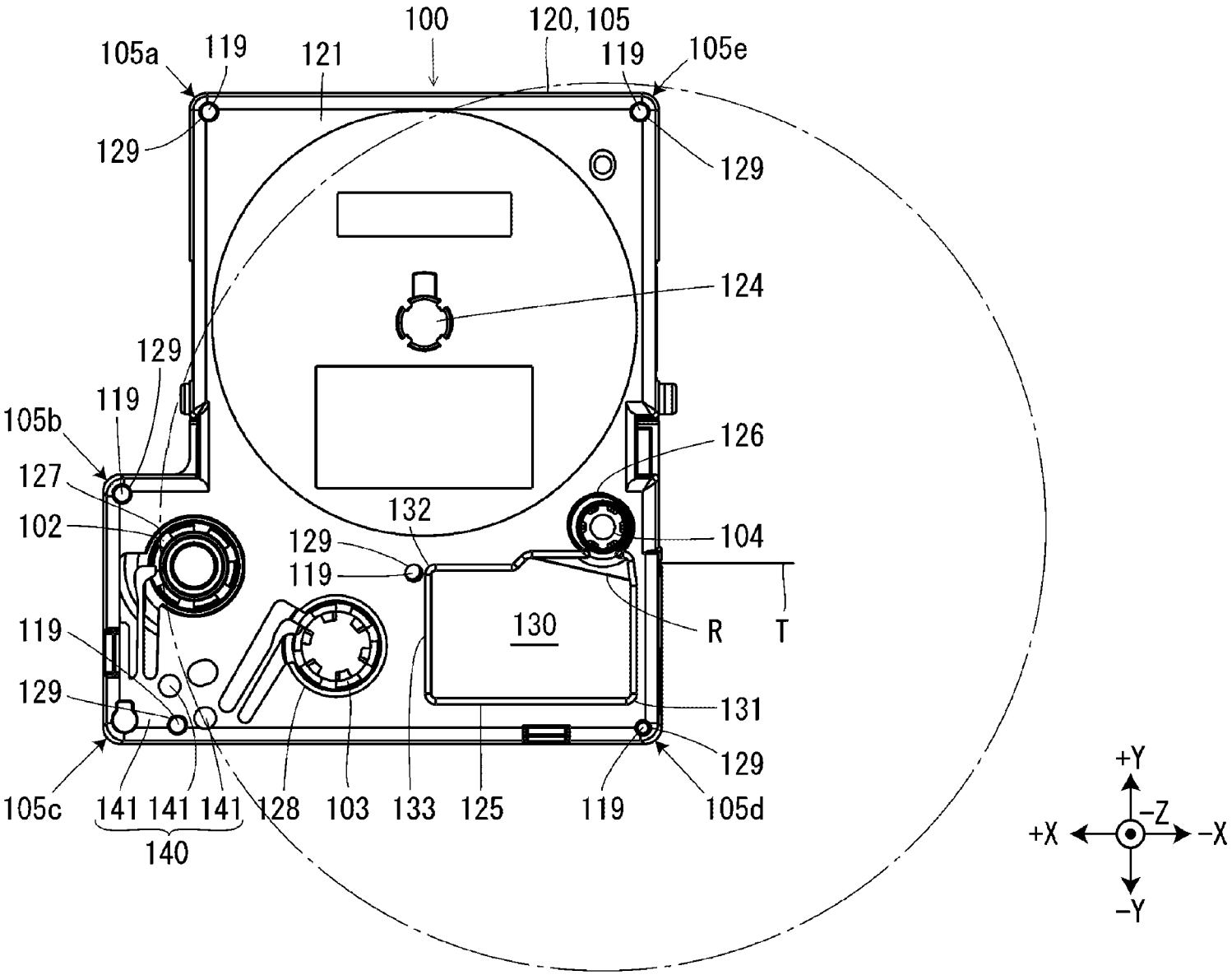
FIG. 4 is a diagram illustrating the tape cartridge seen from a far side in the loading direction of the tape cartridge.

A plurality of fitting pins 119 is provided on the inner surface of the first peripheral wall portion 112 and in the first base portion 111 (specifically, five fitting pins 119 project from an inner surface of the first peripheral wall portion 112 and one fitting pin 119 projects from the first base portion 111) (see FIG. 4). Each of the fitting pins 119 is formed as a substantial cylindrical column projecting on the far side in the loading direction (−Z side) along the inner surface of the first peripheral wall portion 112 or from the first base portion 111. Among the six fitting pins 119, five fitting pins 119 are provided at the first case corner 105*a*, the second case corner 105*b*, the third case corner 105*c*, the fourth case corner 105*d*, and the fifth case corner 105*e*. The rest one of the six fitting pins 119 is provided at the second insertion corner 132.

The second case 120 includes a second base portion 121, a second peripheral wall portion 122, and an insertion peripheral wall portion 123.

In the second base portion 121, a core shaft 124, a second insertion opening 125, a second platen support opening 126, a second sending support opening 127, and a second winding support opening 128 are provided. The core shaft 124 is formed in a substantially cylindrical shape projecting from the second base portion 121 on the near side in the loading direction (+Z side). The tape core 101 round which the tape T is wound in a roll form is rotatably supported by the core shaft 124. The second insertion opening 125 is an end portion of the head inserting portion 130 on the far side in the loading direction (−Z side). An end portion of the platen roller 104 on the far side in the loading direction (−Z side) engages with the second platen support opening 126. The second platen support opening 126 rotatably supports the platen roller 104 with the first platen support opening 116. An end portion of the ribbon sending core 102 on the far side in the loading direction engages with the second sending support opening 127. The second sending support opening 127 rotatably supports the ribbon sending core 102 together with the first sending support portion. An end portion of the ribbon winding core 103 on the far side in the loading direction engages with the second winding support opening 128. The second winding support opening 128 rotatably supports the ribbon winding core 103 together with the first winding support opening 118.

A first detection target portion 140 is provided at the third case corner 105*c* of the second base portion 121. The first detection target portion 140 is constituted by a plurality of (specifically, three) first detection positions 141 corresponding to a plurality of detection switches 14*a* provided in the first detection unit 14 (see FIG. 6). The shapes of the first detection target portion 140 vary depending on the various tape widths of the tape cartridge 100. That is, combinations of existence/non-existence of round hole-shaped recesses at the three first detection positions 141 differ depending on the various types of the tape cartridges 100 (in FIG. 4, the recesses are formed at two first detection positions 141 among the three first detection positions 141). The shapes of the first detection target portion 140 may vary depending on characteristics of the tape cartridge 100 other than the tape width. The same applies to a later-described second detection target portion 150.

The second peripheral wall portion 122 projects on the near side in the loading direction (+Z side) from a peripheral portion of the second base portion 121.

The insertion peripheral wall portion 123 projects on the near side in the loading direction (+Z side) from a peripheral portion of the second insertion opening 125.

A plurality of (specifically, six) fitting holes 129 is provided in the second peripheral wall portion 122 and the insertion peripheral wall portion 123. The fitting pins 119 are inserted (in particular, press-fit) into the fitting holes 129 from the near side in the loading direction (+Z side). The fitting holes 129 are formed as round through holes penetrating the second peripheral wall portion 122 or the insertion peripheral wall portion 123 in the loading direction (a Z direction), and end portions of the fitting holes 129 open to the second base portion 121 on the far side in the loading direction (−Z side).

The fitting holes 129 are provided at positions corresponding to the fitting pins 119. That is, among the six fitting holes 129, five fitting holes 129 are provided at the first case corner 105*a*, the second case corner 105*b*, the third case corner 105*c*, the fourth case corner 105*d*, and the fifth case corner 105*e*. The rest one of the six fitting hole 129 is provided at the second insertion corner 132.

Among the six fitting holes 129, the fitting holes 129 provided at the first case corner 105*a*, the second case corner 105*b*, and the third case corner 105*c* are located farther than the first detection target portion 140 with respect to the platen roller 104 when seen from the far side in the loading direction (−Z side).

Here, "farther than the first detection target portion 140" is a concept that "farther than any of a plurality of first detection positions 141" is desirable, while the concept includes "farther than at least one of a plurality of first detection positions 141" as in the fitting holes 129 provided at the second case corner 105*b* or the third case corner 105*c*. A circle depicted by the dash-dot line in FIG. 4 is a circle about an axis of the platen roller 104 and passes through the first detection position 141 closest to the platen roller 104 among a plurality of first detection positions 141. This circle indicates that the fitting holes 129 provided at the first case corner 105*a*, the second case corner 105*b*, and the third case corner 105*c* are provided at positions farther than the first detection target portion 140 with respect to the platen roller 104.

The fitting holes 129 provided at the fourth case corner 105*d* and the second insertion corner 132 are provided in peripheral portions of the head inserting portion 130 when seen from the far side in the loading direction (−Z side) (specifically, at positions diagonal to each other in the substantially rectangular head inserting portion 130). Further, the fitting hole 129 provided at the second insertion corner 132 is provided in the peripheral portion of the winding core side insertion side 133 among the peripheral portions of the head inserting portion 130.

When the fitting pins 119 are inserted into the fitting holes 129 from the near side in the loading direction (+Z side), the first case 110 and the second case 120 are assembled to each other. Lengths of the fitting holes 129 are longer than the lengths of fitting pins 119. That is, the fitting pins 119 enter the fitting holes 129 halfway from the near side in the loading direction. Therefore, the positioning projection 49 (see FIG. 6) can engage with the fitting hole 129 from the far side in the loading direction (−Z side). The first case 110 and the second case 120 can be separated when, for example, an operator operates a separation apparatus provided with extrusion pins to be inserted into the fitting holes 129 from the far side in the loading direction, and extrudes the fitting pins 119 from the fitting holes 129.

The second detection target portion 150 is provided at the fourth case corner 105*d* of the second peripheral wall portion 122. The shapes of the second detection target portion 150 vary depending on the various tape widths of the tape cartridge 100. That is, existence/non-existence of a groove-shaped recess extending in the loading direction of the second detection target portion 150 differs depending on the type of tape cartridge 100 (no recess is formed in the second detection target portion 150 in FIG. 4).

Figure 5:
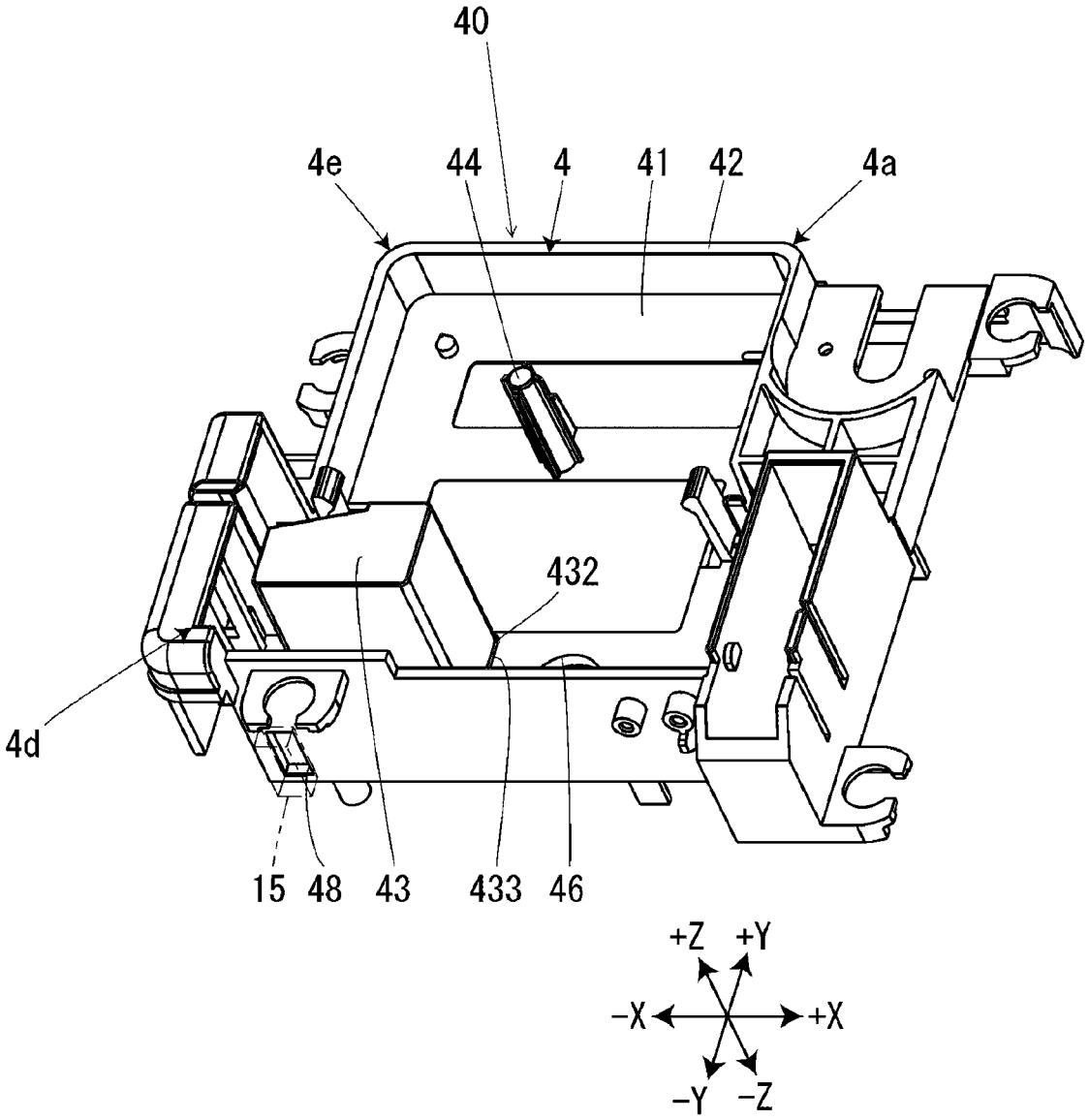
FIG. 5 is a perspective view of a loading case member.
Figure 6:
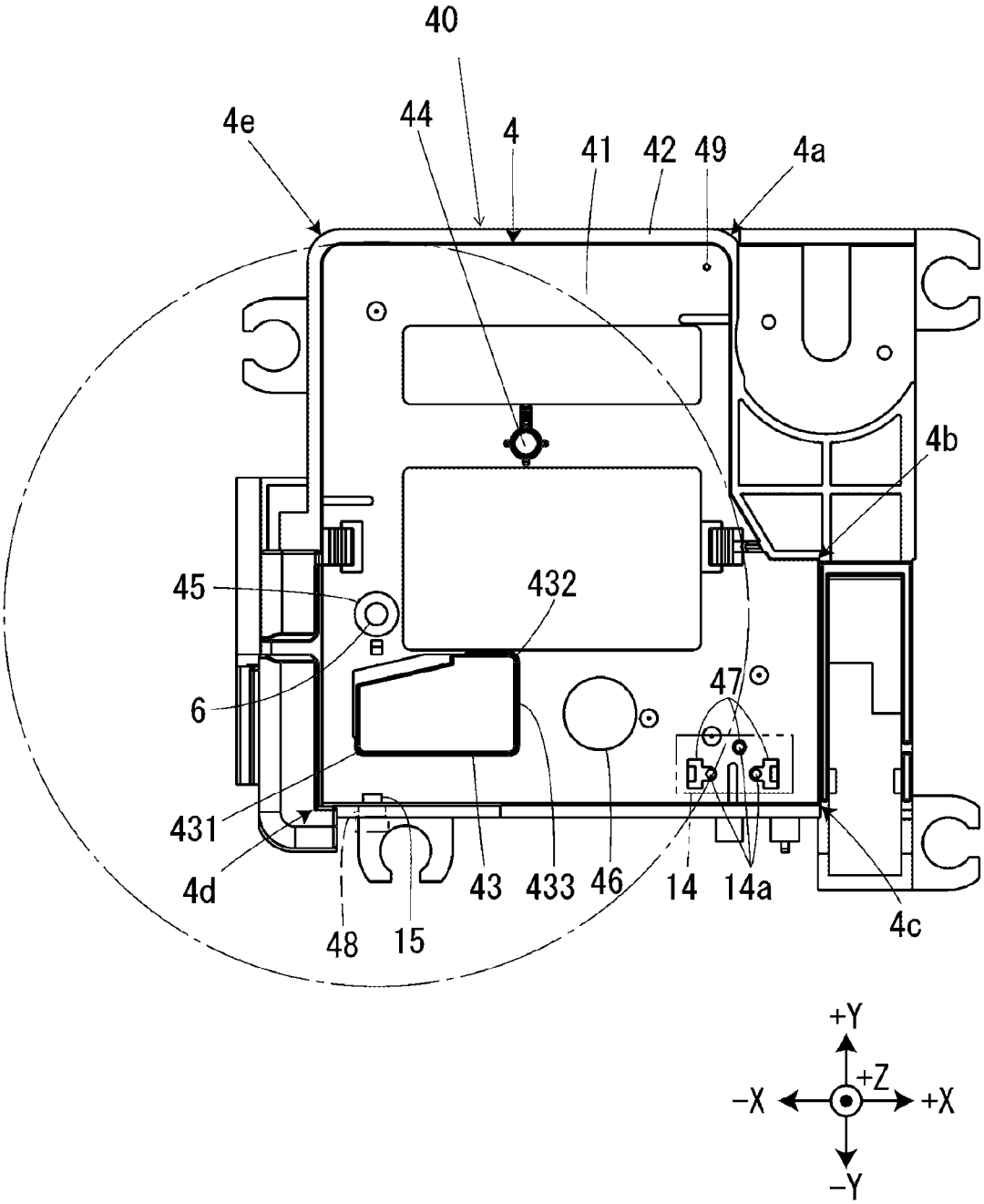
FIG. 6 is a diagram illustrating the loading case member of the first embodiment seen from a near side in the loading direction of the tape cartridge.

A loading case member 40 to which the cartridge loading portion 4 is formed, and the first detection unit 14 and the second detection unit 15 provided in the loading case member 40 will be described with reference to FIGS. 5 and 6.

The loading case member 40 is made of resin and is formed by injection molding. However, the materials and the manufacturing process of the loading case member 40 are not limited to those described above. The loading case member 40 includes a loading base portion 41 and a loading peripheral wall portion 42. The loading base portion 41 and the loading peripheral wall portion 42 constitute the cartridge loading portion 4.

The cartridge loading portion 4 has a shape complementary to that of the tape cartridge 100 when seen from the near side in the loading direction (+Z side), that is, a substantially "L" shape, with five corners. Among the five corners, a corner on the +X side and the +Y side is defined as a first loading corner 4*a*, a corner on the +X side and the −Y side is defined as a third loading corner 4*c*, a corner on a −X side and the −Y side is defined as a fourth loading corner 4*d*, a corner on the −X side and the +Y side is defined as a fifth loading corner 4*e*, and a corner between the first loading corner 4*a* and the third loading corner 4*c* is defined as a second loading corner 4*b*.

The loading base portion 41 faces and contacts the second base portion 121 of the tape cartridge 100 loaded in the cartridge loading portion 4. The head cover 43, a shaft insertion projection 44, a platen shaft opening 45, a winding shaft opening 46, and a plurality of (specifically, three) first detection openings 47 are provided in the loading base portion 41.

The head cover 43 is provided at the fourth loading corner 4*d* of the loading base portion 41. The head cover 43 projects on the near side in the loading direction (+Z side) from the loading base portion 41. The head cover 43 is formed in a shape complementary to a contour of the head cover 43, that is, the head cover 43 is substantially rectangular when seen from the near side in the loading direction. Here, "the head cover 43 is substantially rectangular" is a concept that the head cover 43 is rectangular with rounded corners, or rectangular with one or more beveled corners as in the head cover 43 illustrated in FIG. 6. Here, among the four corners of the head cover 43, a corner at the fourth loading corner 4*d* is defined as a first cover corner 431 when seen from the near side in the loading direction, and a corner diagonal to the first cover corner 431 is defined as a second cover corner 432. Among four sides which constitute the contour of the head cover 43, the side closest to the winding shaft 7 is referred to as a winding shaft-side cover side 433 when seen from the near side in the loading direction.

The shaft insertion projection 44 projects from the loading base portion 41 on the near side in the loading direction (+Z side). The shaft insertion projection 44 is inserted into the cylindrical core shaft 124.

The platen shaft opening 45 is provided on the +Y side of the head cover 43. The platen shaft 6 to be inserted into the platen roller 104 projects from the platen shaft opening 45 on the near side in the loading direction.

The winding shaft opening 46 is provided on the +X side of the head cover 43. The winding shaft 7 to be inserted into the ribbon winding core 103 projects from the winding shaft opening 46 on the near side in the loading direction.

The first detection opening 47 is provided at the third loading corner 4*c* of the loading base portion 41. A detecting device of a detection switch 14*a* projects from the first detection opening 47 to be retractable into the cartridge loading portion 4.

The first detection unit 14 is located at the third loading corner 4*c* and is provided on the back side (−Z side) of the loading base portion 41. The first detection unit 14 includes a plurality of (specifically, three) detection switches 14*a*. In accordance with the shape of the first detection positions 141 (in particular, existence/non-existence of the recess in the first detection positions 141) of the tape cartridge 100 loaded in the cartridge loading portion 4, the detection switches 14*a* are switched between a state in which the detecting devices project from the first detection opening 47 on the near side in the loading direction (+Z side) and a state in which the detecting devices are retracted into the first detection opening 47, whereby output (ON/OFF) is changed. Therefore, a combination of outputs of a plurality of detection switches 14*a* changes in accordance with a combination of shapes of a plurality of first detection positions 141. That is, outputs of the first detection unit 14 change in accordance with the shape of the first detection target portion 140 of the tape cartridge 100 loaded in the cartridge loading portion 4. As the detection switch 14*a*, a microswitch may be used, for example.

The loading peripheral wall portion 42 projects on the near side in the loading direction (+Z side) from the peripheral portion of the loading base portion 41. A second detection opening 48 is provided at the fourth loading corner 4*d* of the loading peripheral wall portion 42. From the second detection opening 48, a detecting device of the second detection unit 15 projects in a manner as to be retractable into the cartridge loading portion 4.

The second detection unit 15 is located at the fourth loading corner 4*d* and is provided on the outside of the loading peripheral wall portion 42. In accordance with the shape of the second detection target portion 150 of the tape cartridge 100 loaded in the cartridge loading portion 4 (in particular, existence/non-existence of the recess in the first detection target portion 140), the second detection unit 15 switches between a state in which the detecting devices project from the second detection opening 48 on the +Y side, and a state in which the detecting devices are retracted into the second detection opening 48, whereby output (ON/OFF) changes. Therefore, outputs of the second detection unit 15 change in accordance with a shape of the second detection target portion 150 of the tape cartridge 100 loaded in the cartridge loading portion 4. Based on the output of the second detection unit 15 and the output of the first detection unit 14, the controller 13 detects the type, that is, the tape width, of the tape cartridge 100 loaded in the cartridge loading portion 4.

The positioning projection 49 is provided at the first loading corner 4*a* of the loading base portion 41. The positioning projection 49 projects on the near side in the loading direction (+Z side) from the loading base portion 41 in a substantially cylindrical column shape. A projection height of the positioning projection 49 is lower than projection heights of the head cover 43, the shaft insertion projection 44, the platen shaft 6, and the winding shaft 7. Therefore, when the tape cartridge 100 is loaded in the cartridge loading portion 4, the head cover 43, the shaft insertion projection 44, the platen shaft 6, and the winding shaft 7 are first inserted into the head inserting portion 130, the core shaft 124, the platen roller 104, and the ribbon winding core 103, respectively. Then, when the tape cartridge 100 proceeds on the far side in the loading direction (−Z side), the positioning projection 49 engages with the fitting hole 129. A projection height of the positioning projection 49 is lower than the length of a space of the fitting hole 129 into which the fitting pin 119 has been inserted. Therefore, in a state in which the positioning projection 49 engages with the fitting hole 129, the tape cartridge 100 is in contact with the loading base portion 41 without being separated from the loading base portion 41.

When the positioning projection 49 engages with the fitting hole 129, the tape cartridge 100 is positioned in the cartridge loading portion 4. That is, an amount of a backlash between the positioning projection 49 and the fitting hole 129 is smaller than an amount of a backlash in other locations (for example, an amount of a backlash between the shaft insertion projection 44 and the core shaft 124).

The positioning projection 49 is located farther than the first detection unit 14 with respect to the platen shaft 6. That is, a distance between the positioning projection 49 and the platen shaft 6 is longer than a distance between the first detection unit 14 and the platen shaft 6. Therefore, also when the platen roller 104 is rotated in a state in which the tape cartridge 100 is loaded in the cartridge loading portion 4 and the tape cartridge 100 is rotated about the platen shaft 6, a shift amount of the first detection target portion 140 with respect to the first detection unit 14 becomes smaller than an amount of a backlash between the positioning projection 49 and the fitting hole 129. Therefore, the first detection target portion 140 can be correctly positioned with respect to the first detection unit 14. Therefore, incorrect outputting by the first detection unit 14 different from the output corresponding to the shape of the first detection target portion 140 of the tape cartridge 100 loaded in the cartridge loading portion 4 can be reduced. As a result, incorrect detection by the controller 13 of the type of the tape cartridge 100 loaded in the cartridge loading portion 4 can be reduced.

Here, "farther than the first detection unit 14" is a concept that "farther than any of a plurality of detection switches 14*a*" is desirable, while the concept includes "farther than at least one of a plurality of detection switches 14*a*" as in a positioning projection 49 of a later-described first alternative embodiment or a second alternative embodiment. A circle depicted by the dash-dot line in FIG. 6 is a circle about the center of the platen shaft opening 45 and passes through the detection switch 14*a* closest to the center of the platen shaft opening 45 among a plurality of detection switches 14*a*. This circle indicates that the positioning projection 49 is provided at a position farther than the first detection unit 14 with respect to the platen shaft 6 projecting from the platen shaft opening 45 (the same applies to the circles depicted by the dash-dot lines in FIGS. 7 and 8).

Next, alternative embodiments of the first embodiment will be described. In the alternative embodiments, the same description as that of the first embodiment will be omitted and differences from the first embodiment will be described mainly. The same applies to a later-described second embodiment and alternative embodiments thereof.

Figure 7:
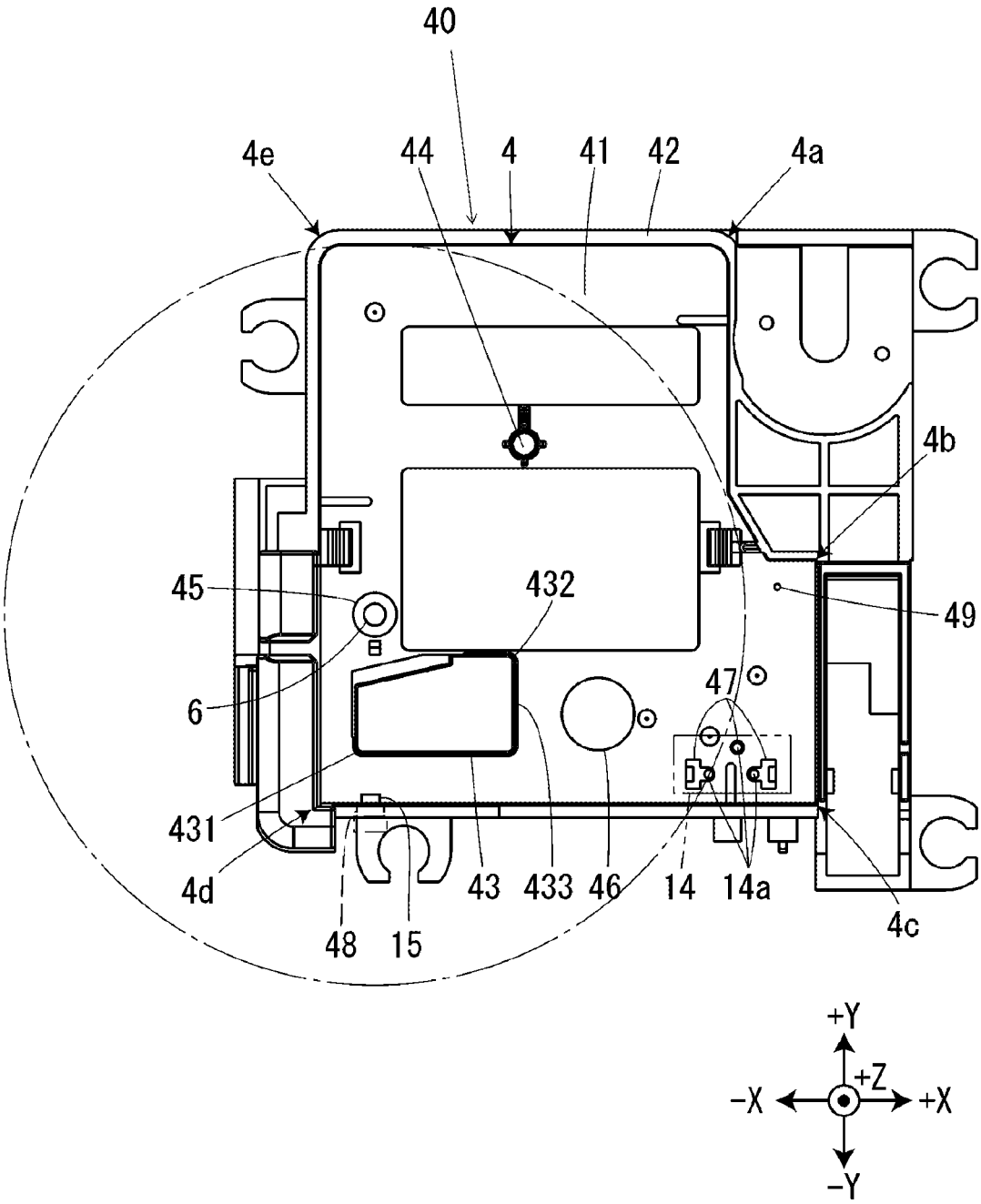
FIG. 7 is a diagram illustrating a loading case member of a first alternative embodiment seen from the near side in the loading direction of the tape cartridge.

A loading case member 40 provided in a tape printer A of a first alternative embodiment which is an alternative embodiment of the first embodiment will be described with reference to FIG. 7. In the tape printer A according to the first alternative embodiment, a positioning projection 49 is provided at a second loading corner 4*b* of a loading base portion 41. When a tape cartridge 100 is loaded in a cartridge loading portion 4, the positioning projection 49 engages with a fitting hole 129 provided at the second case corner 105*b*. The positioning projection 49 is located farther than a first detection unit 14 with respect to a platen shaft 6 as in the positioning projection 49 of the first embodiment. Therefore, the tape printer A according to the first alternative embodiment produces the same operation and effect as those of the tape printer A according to the first embodiment.

Figure 8:
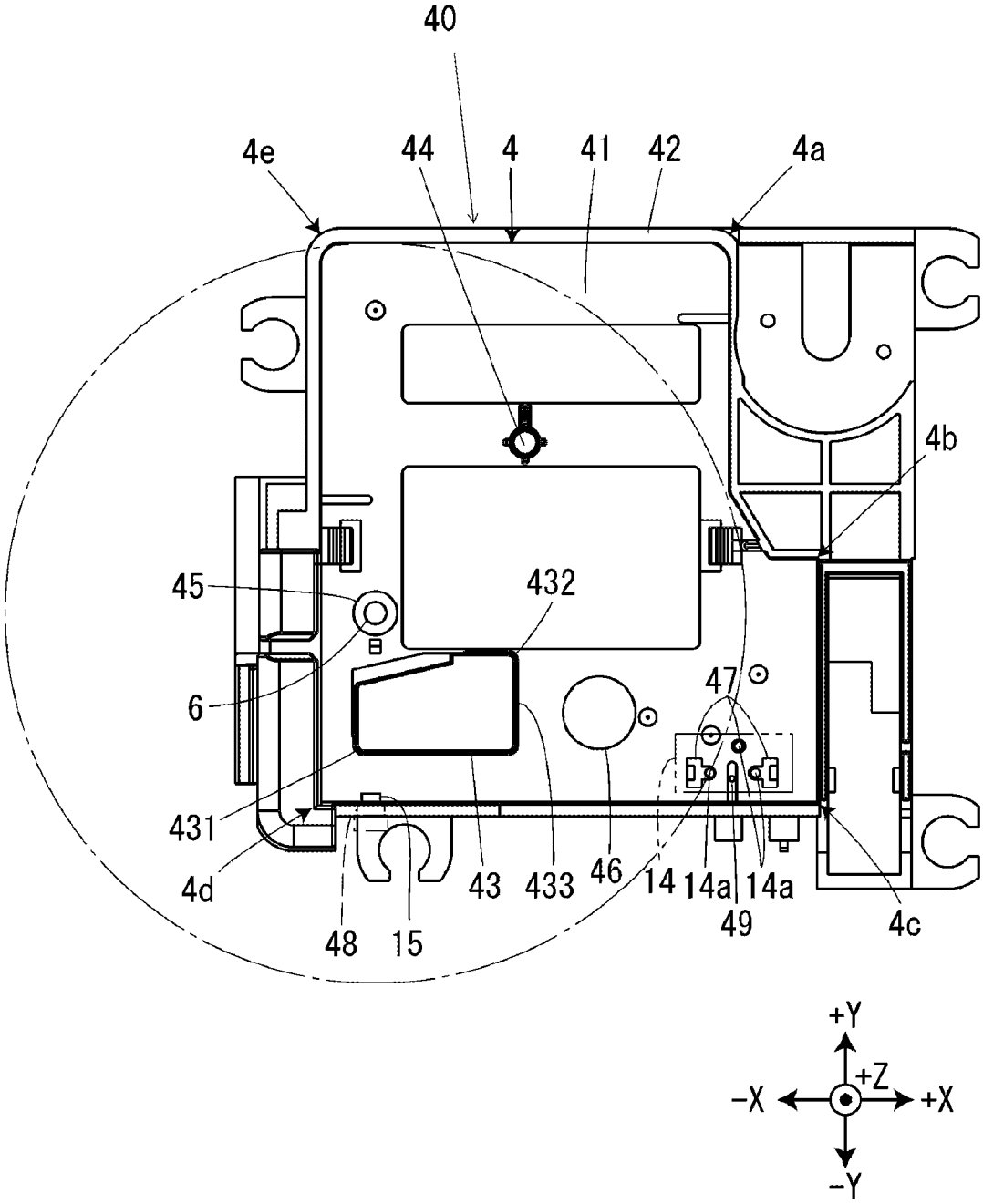
FIG. 8 is a diagram illustrating a loading case member of a second alternative embodiment seen from the near side in the loading direction of the tape cartridge.

A loading case member 40 provided in a tape printer A of a second alternative embodiment which is another alternative embodiment of the first embodiment will be described with reference to FIG. 8. In the tape printer A according to the second alternative embodiment, a positioning projection 49 is provided at a third loading corner 4*c* of a loading base portion 41. When a tape cartridge 100 is loaded in a cartridge loading portion 4, the positioning projection 49 engages with a fitting hole 129 provided at the third case corner 105*c*. The positioning projection 49 is located farther than a first detection unit 14 with respect to a platen shaft 6 as in the positioning projection 49 of the first embodiment. Therefore, the tape printer A according to the second alternative embodiment produces the same operation and effect as those of the tape printer A according to the first embodiment.

In the tape printer A according to the second alternative embodiment, the positioning projection 49 is provided at the third loading corner 4*c* at which the first detection unit 14 is provided. That is, the positioning projection 49 is provided close to the first detection unit 14. Therefore, a dimension error between the positioning projection 49 and the first detection unit 14 can be reduced. Therefore, in a state in which the positioning projection 49 engages with the fitting hole 129, the first detection target portion 140 can be correctly positioned with respect to the first detection unit 14.

Figure 9:
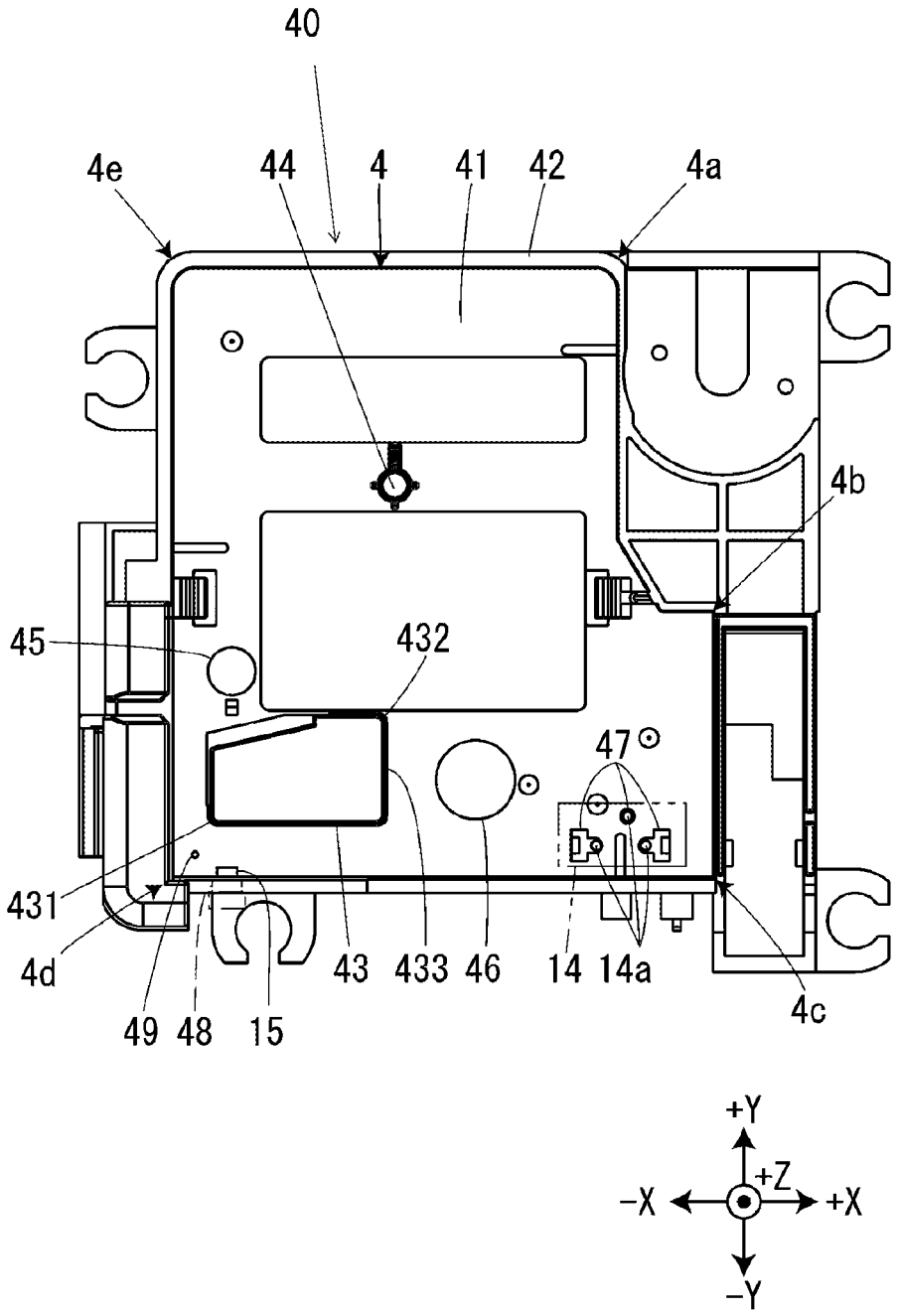
FIG. 9 is a diagram illustrating a loading case member of a second embodiment seen from the near side in the loading direction of the tape cartridge.

A loading case member 40 provided in a tape printer A of a second embodiment will be described with reference to FIG. 9. The tape printer A according to the second embodiment is different from the tape printer A according to the first embodiment in that a positioning projection 49 is provided in a peripheral portion of a head cover 43 instead of a position farther than a first detection unit 14 with respect to a platen shaft 6. That is, in the tape printer A according to the second embodiment, the positioning projection 49 is provided at a fourth loading corner 4*d* of a loading base portion 41. When a tape cartridge 100 is loaded in a cartridge loading portion 4, the positioning projection 49 engages with a fitting hole 129 provided at a fourth case corner 105*d*. The positioning projection 49 is provided in a peripheral portion of a head cover 43 which covers a thermal head 8. That is, the positioning projection 49 is provided close to the thermal head 8. Therefore, a dimension error between the positioning projection 49 and the thermal head 8 can be reduced. Therefore, in a state in which the positioning projection 49 engages with the fitting hole 129, the platen roller 104 can be correctly positioned with respect to the thermal head 8. Therefore, print quality of a tape T by the thermal head 8 can be improved.

In the tape printer A according to the second embodiment, the positioning projection 49 is provided at the fourth loading corner 4*d* at which the second detection unit 15 is provided. That is, the positioning projection 49 is provided close to the second detection unit 15. Therefore, a dimension error between the positioning projection 49 and the second detection unit 15 can be reduced. Therefore, in a state in which the positioning projection 49 engages with the fitting hole 129, the second detection target portion 150 can be correctly positioned with respect to the second detection unit 15. Therefore, incorrect outputting by the second detection unit 15 different from the output corresponding to the shape of the second detection target portion 150 of the tape cartridge 100 loaded in the cartridge loading portion 4 can be reduced. As a result, incorrect detection by the controller 13 of the type of the tape cartridge 100 loaded in the cartridge loading portion 4 can be reduced.

Figure 10:
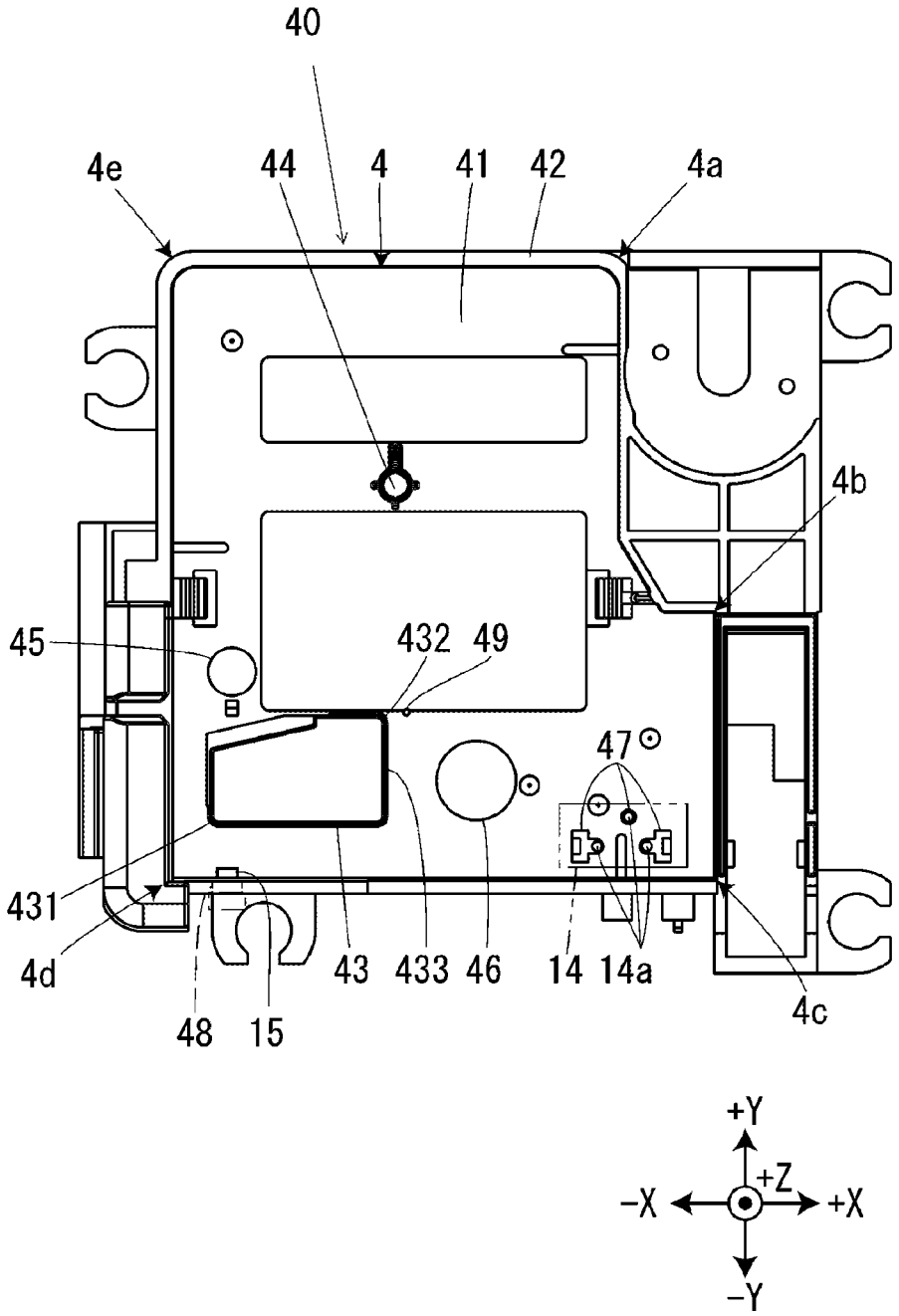
FIG. 10 is a diagram illustrating a loading case member of a third alternative embodiment seen from the near side in the loading direction of the tape cartridge.

A loading case member 40 provided in a tape printer A of a third alternative embodiment which is an alternative embodiment of the second embodiment will be described with reference to FIG. 10. In the tape printer A according to the third alternative embodiment, a positioning projection 49 is provided at a second cover corner 432 of a loading base portion 41. When a tape cartridge 100 is loaded in a cartridge loading portion 4, the positioning projection 49 engages with a fitting hole 129 provided at a second insertion corner 132. The positioning projection 49 is provided in a peripheral portion of the head cover 43 as in the positioning projection 49 of the second embodiment. That is, the positioning projection 49 is provided close to the thermal head 8. Therefore, the tape printer A according to the third alternative embodiment produces the same operation and effect as those of the tape printer A according to the second embodiment.

In the tape printer A according to the third alternative embodiment, the positioning projection 49 is provided in the peripheral portion of the head cover 43 at a position close to a winding shaft-side cover side 433. That is, the positioning projection 49 is provided at a position close to a winding shaft 7 projecting toward the winding shaft opening 46. Therefore, a dimension error between the positioning projection 49 and the winding shaft 7 can be reduced. Therefore, in a state in which the positioning projection 49 engages with the fitting hole 129, a first winding support opening 118 and a second winding support opening 128 can be correctly positioned with respect to the winding shaft 7. Therefore, sliding load is produced between a ribbon winding core 103 into which the winding shaft 7 has been inserted and a first winding support opening 118 or a second winding support opening 128, whereby winding force of the ribbon winding core 103 becoming insufficient can be reduced. Therefore, jumping of an ink ribbon R out of a tape sending-out port 106 together with a tape T without being separated from the tape T or occurrence of wrinkles on the ink ribbon R can be reduced.

Figure 11:
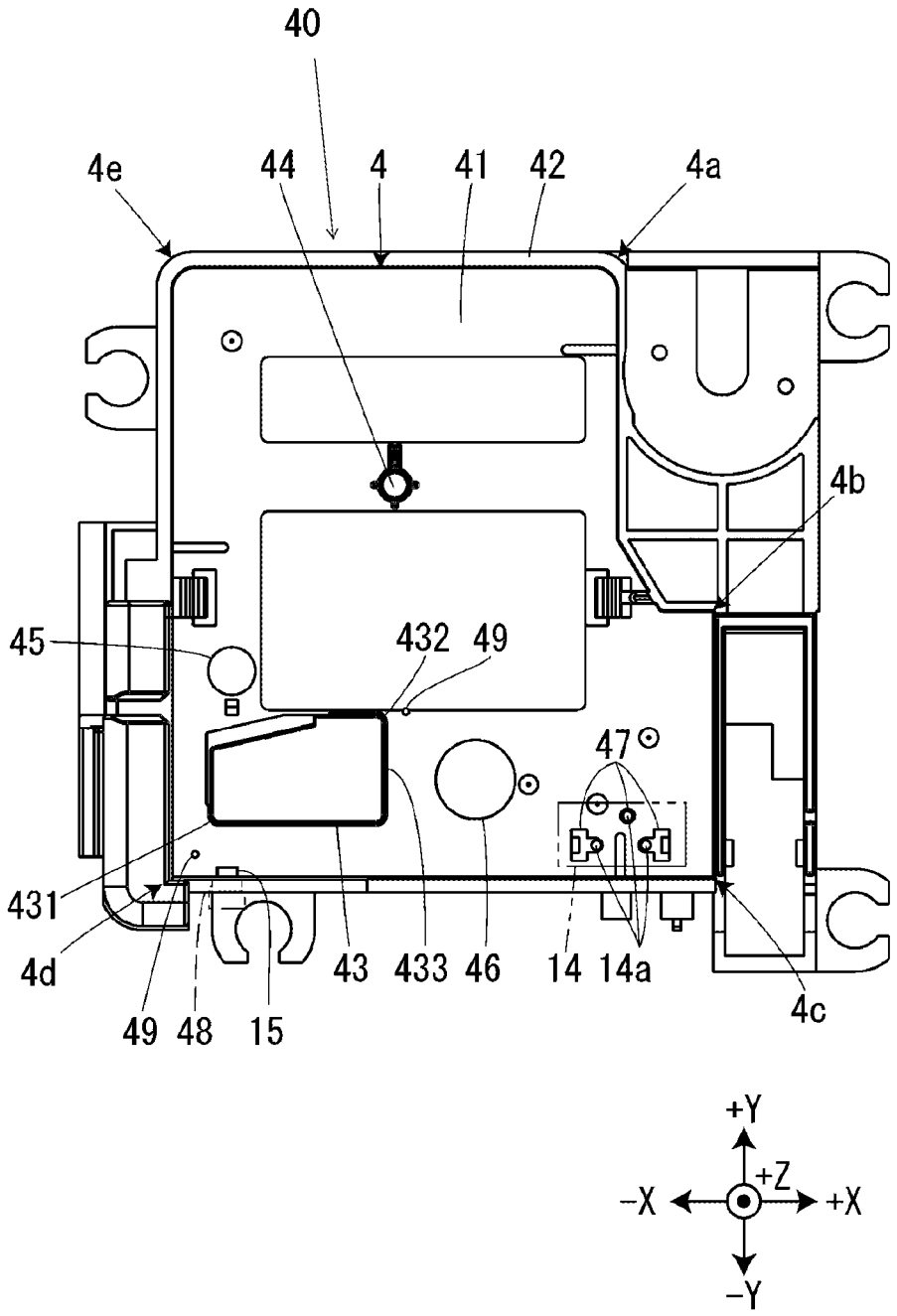
FIG. 11 is a diagram illustrating a loading case member of a fourth alternative embodiment seen from the near side in the loading direction of the tape cartridge.

A loading case member 40 provided in a tape printer A of a fourth alternative embodiment which is another alternative embodiment of the second embodiment will be described with reference to FIG. 11. In the tape printer A according to the fourth alternative embodiment, two positioning projections 49 are provided in a loading base portion 41. A first positioning projection 49 is provided in the fourth loading corner 4*d* as in the second embodiment. Therefore, the tape printer A according to the fourth alternative embodiment produces the same operation and effect as those of the second embodiment. A second positioning projection 49 is provided in a second cover corner 432 as in the third alternative embodiment. Therefore, the tape printer A according to the fourth alternative embodiment produces the same operation and effect as those of the third alternative embodiment. The two positioning projections 49 are provided at mutually diagonal positions of a head cover 43 when seen from the near side in the loading direction (+Z side), and engage with fitting holes 129 provided at mutually diagonal positions of a head inserting portion 130. Therefore, since the positioning projections 49 engage with the fitting holes 129 at the mutually diagonal positions of the head cover 43, a platen roller 104 can be correctly positioned with respect to a thermal head 8.

As described above, the tape printers A according to the first embodiment and the alternative embodiments of the invention each include the cartridge loading portion 4, the platen shaft 6, the first detection unit 14, and the positioning projection 49. The tape cartridge 100 is loaded in the cartridge loading portion 4. The tape cartridge 100 includes the cartridge case 105, and the platen roller 104 accommodated in the cartridge case 105. The fitting holes 129 and the first detection target portion 140 are provided in the cartridge case 105. The shapes of the first detection target portion 140 vary depending on the various types of the tape cartridge 100. The platen shaft 6 is provided in the cartridge loading portion 4 and is inserted into the platen roller 104. The first detection unit 14 is provided in the cartridge loading portion 4. Output of the first detection unit 14 changes depending on the shape of the first detection target portion 140. In the cartridge loading portion 4, the positioning projection 49 is located farther than the first detection unit 14 with respect to the platen shaft 6 when seen from the near side in the loading direction, and engages with the fitting hole 129. With this configuration, the tape cartridge 100 can be correctly positioned in the cartridge loading portion 4.

The tape printers A according to the second embodiment of the invention and the alternative embodiments thereof each include the cartridge loading portion 4, the thermal head 8, the head cover 43, and the positioning projection 49. The tape cartridge 100 is replaceably loaded in the cartridge loading portion 4. The tape cartridge 100 includes the cartridge case 105, and the platen roller 104 accommodated in the cartridge case 105. The fitting holes 129 and the head inserting portion 130 are provided in the cartridge case 105. The thermal head 8 is provided in the cartridge loading portion 4, and prints on the tape T pinched between the thermal head 8 and the platen roller 104. The head cover 43 is provided in the cartridge loading portion 4 so as to cover the thermal head 8, and is inserted into the head inserting portion 130. In the cartridge loading portion 4, the positioning projection 49 is provided in the peripheral portion of the head cover 43 when seen from the near side in the loading direction, and engages with the fitting hole 129. With this configuration, the tape cartridge 100 can be correctly positioned in the cartridge loading portion 4.

The fitting hole 129 is an example of "positioning recess." The thermal head 8 is an example of "print head." The first winding support opening 118 and the second winding support opening 128 are examples of "winding support portion." The invention is not limited to the embodiments described above and various configurations can be employed without departing from the scope of the invention. For example, the present embodiment can be changed into the following forms besides the alternative embodiments described above.

The number of the positioning projections 49 is not limited to one or two, and the number may be three or more. If the number of the positioning projections 49 is two or more, the combination of the fitting holes 129 to engage with the positioning projections 49 is also not particularly limited.

When the positioning projection 49 is located farther than the first detection unit 14 with respect to the platen shaft 6, the position is not limited to the corner of the cartridge loading portion 4. For example, the positioning projection 49 may be provided in a curved or linear peripheral portion of the cartridge loading portion 4. Similarly, when the fitting hole 129 with which the positioning projection 49 engages is located farther than the first detection target portion 140 with respect to the platen roller 104, the position of the fitting hole 129 is not limited at the corner of the tape cartridge 100.

If the positioning projection 49 is provided in the peripheral portion of the head cover 43, the position of the positioning projection 49 is not limited to the corner of the head cover 43. That is, the positioning projection 49 may be provided between the corners of the head cover 43. Similarly, if the fitting hole 129 with which the positioning projection 49 engages is provided in the peripheral portion of the head inserting portion 130, the position of the fitting hole 129 is not limited to the corner of the head inserting portion 130.

The positioning recess with which the positioning projection 49 engages does not necessarily be a fitting hole 129 into which the fitting pin 119 is inserted. For example, the positioning recess may be a non-through hole provided on an outer surface of the second base portion 121.

The material of the positioning projection 49 does not necessarily be limited to resin, and may be metal, for example. According to this configuration, since intensity of the positioning projection 49 increases, the positioning projection 49 being damaged can be reduced.

The positioning projection 49 does not necessarily be integrated with the loading case member 40, and may be separated from the loading case member 40. In this case, the positioning projection 49 may be fixed to a frame provided on a far side in the loading direction with respect to the loading base portion 41 together with the platen shaft 6 and the winding shaft 7. According to this configuration, accuracy of position of the positioning projection 49 with respect to the platen shaft 6 or the winding shaft 7 can be increased.

The positioning projection 49 may be retracted into the projection opening provided in the loading base portion 41 when the tape cartridge cover 3 is opened, and project from the projection opening when the tape cartridge cover 3 is closed. In this case, the positioning projection 49 may desirably include a substantially conical end portion and a substantially cylindrical column body part. When the tape cartridge cover 3 is opened, the positioning projection 49 may desirably be retracted into the projection opening so that only the end portion of the positioning projection 49 projects from the projection opening, and when the tape cartridge cover 3 is closed, the positioning projection 49 including the body part may desirably project from the projection opening. According to this configuration, only the end portion of the positioning projection 49 projects from the projection opening in the state in which the tape cartridge cover 3 is opened. Therefore, the positioning projection 49 hitting the peripheral portion of the fitting hole 129 when the tape cartridge 100 is loaded can be reduced and the positioning projection 49 being damaged can be reduced. When the tape cartridge cover 3 is opened, only the end portion engages with the positioning projection 49. Therefore, the tape cartridge 100 can be positioned roughly. When the tape cartridge cover 3 is closed, the positioning projection 49 projects and engages with the fitting hole 129. Therefore, the tape cartridge 100 can be correctly positioned.

This application claims priority under 35 U.S.C. § 119 to Japanese Patent Application No. 2017-045921, filed Mar. 10, 2017. The entire disclosure of Japanese Patent Application No. 2017-045921 is hereby incorporated herein by reference.

What is claimed is:

1. A tape printer, comprising:

a cartridge loading portion to which a tape cartridge is loaded, the tape cartridge including a cartridge case and a platen roller accommodated in the cartridge case, the cartridge case having a positioning recess and a head inserting portion;

a print head provided in the cartridge loading portion and configured to print on a tape pinched between the print head and the platen roller;

a substantially rectangular head cover provided in the cartridge loading portion so as to cover the print head, wherein the head cover is configured to be inserted into the head inserting portion; and a positioning projection provided in a peripheral portion of the head cover in the cartridge loading portion when seen from a near side in a loading direction of the tape cartridge, wherein the positioning projection is configured to engage with the positioning recess, wherein the cartridge case includes a first case that includes a fitting pin, and a second case that has a fitting hole into which the fitting pin is to be inserted and that is assembled separable from the first case, and the positioning projection engages with the fitting hole which functions as the positioning recess.

2. The tape printer according to claim 1, wherein the positioning projection is provided at each of mutually diagonal positions of the head cover when seen from the near side in the loading direction of the tape cartridge.

3. The tape printer according to claim 1, wherein the cartridge case includes a second detection target portion of which shape is varied depending on various types of the tape cartridge, the tape printer further includes a second detection unit provided at one of a plurality of corners of the cartridge loading portion when seen from the near side in the loading direction of the tape cartridge and of which output changes depending on the shape of the second detection target portion, and the positioning projection is provided in the cartridge loading portion at a corner at which the second detection unit is provided.

4. The tape printer according to claim 1, wherein a winding support portion that rotatably supports a ribbon winding core is provided in the cartridge case, the tape printer further includes a winding shaft provided in the cartridge loading portion and is inserted into the ribbon winding core, and the positioning projection is provided in a peripheral portion of a side closest to the winding shaft when seen from the near side in the loading direction of the tape cartridge, among a plurality of sides which constitute a contour of the head cover.

* * * * *